US005146901A

United States Patent [19]

Jones

[11] Patent Number: 5,146,901

[45] Date of Patent: Sep. 15, 1992

[54] VAPOR SUPPRESSING FUEL HANDLING SYSTEM

[75] Inventor: Grady D. Jones, Burton, Mich.

[73] Assignee: General Motors Corporation, Detroit, Mich.

[21] Appl. No.: 829,192

[22] Filed: Feb. 3, 1992

[51] Int. Cl.[5] ..... F02M 33/02; F02M 37/04

[52] U.S. Cl. ..... 123/516; 123/509; 123/514; 123/518; 417/205; 137/565; 137/587

[58] Field of Search ..... 123/497, 495, 509, 506, 123/511, 514, 516, 518, 519, 520; 417/205, 366, 435; 137/565, 587, 589

[56] References Cited

U.S. PATENT DOCUMENTS

| | | | |
|---|---|---|---|
| 2,878,889 | 3/1959 | Gilbert | 183/2.5 |
| 4,205,947 | 6/1980 | Ruhl et al. | 417/205 |
| 4,231,719 | 11/1980 | Ringwald et al. | 417/366 |
| 4,450,820 | 5/1984 | Haynes | 123/516 |
| 4,694,857 | 9/1987 | Harris | 137/565 |
| 4,753,262 | 6/1988 | Bergsma | 137/39 |
| 4,831,990 | 5/1989 | Tuckey | 123/514 |
| 4,844,704 | 7/1989 | Jiro | 417/435 |
| 4,865,522 | 9/1989 | Radermacher | 417/203 |
| 4,869,225 | 9/1989 | Nagata et al. | 123/514 |
| 4,871,041 | 10/1989 | Saito et al. | 417/366 |
| 4,919,103 | 4/1990 | Ishigulo et al. | 123/509 |
| 4,928,657 | 5/1970 | Asselin | 123/509 |
| 4,974,570 | 12/1990 | Szwargulski et al. | 123/514 |
| 4,989,572 | 2/1991 | Giacomazzi et al. | 123/514 |
| 5,036,822 | 8/1991 | Kojima | 417/366 |
| 5,039,284 | 8/1991 | Talaski | 417/366 |
| 5,050,567 | 9/1991 | Suzuki | 123/509 |
| 5,058,557 | 10/1991 | Frank et al. | 123/509 |
| 5,070,849 | 12/1991 | Rich et al. | 123/509 |

*Primary Examiner*—Tony M. Argenbright
*Assistant Examiner*—Thomas N. Moulis
*Attorney, Agent, or Firm*—Patrick M. Griffin

[57] ABSTRACT

A fuel handling system incorporates a reservoir canister within the fuel tank that is enclosed, but for a float controlled vapor vent valve with a vent orifice of predetermined size. A second stage pump sends fuel to the engine, with unused fuel being returned to the canister through a bubble separator that removes the entrained fuel vapor bubbles and sends them into a vapor space just below the top of the canister. A first stage pump continually runs to send fuel into the canister, thereby maintaining the vapor space at a vapor suppressing elevated pressure. When the vapor space grows far enough that the float falls and opens the vapor space, fuel sent in by the first stage pump and vapor is expelled. The orifice is large enough to allow the vapor to be expelled, but small enough, relative to the first stage pump's capacity, that a vapor suppressing pressure is substantially maintained.

2 Claims, 4 Drawing Sheets

VAPOR SUPPRESSING FUEL HANDLING SYSTEM

This invention relates to vehicle fuel emissions in general, and specifically to a fuel handling system designed to reduce fuel vapor emissions.

BACKGROUND OF THE INVENTION

Modern automotive vehicles use a vapor storage device to collect fuel vapor that would otherwise simply be vented from the storage fuel tank and from the fuel system. The fuel tank produces some fuel vapors by diurnal cycling. An even greater volume of fuel vapor is produced as the vehicle operates, the so called running losses. When fuel sent from the fuel tank and not burned in the engine is returned to the fuel tank, it is warmer, especially in vehicles using fuel injection systems, and is permeated with many small fuel vapor bubbles. The return of fuel in this condition accelerates fuel vapor formation in the tank. An even greater volume of fuel vapor is displaced whenever the tank is filled, and future regulations will require that this, too, be collected, rather than being vented. Therefore, any means that could reduce fuel vaporization in the tank and free up vapor storage capacity would be of great use.

Most vehicles have a fuel handling system to assure a steady supply of fuel from the tank to the engine. Typically, some kind of reservoir canister is used to assure a continual supply of fuel to the inlet of the fuel pump, avoiding the temporary fuel starvation that could be caused by fast cornering or low fuel. With fuel injection systems, such systems often include a two stage pump. A first stage pump sends fuel directly from the tank into the reservoir canister, while a second stage, higher pressure pump sends fuel from the canister through the fuel rail of the engine. Some systems also route the return fuel back to the canister, to help keep the canister filled, and provide an outlet to the fuel tank to let fuel vapor escape the canister. While such systems assure a supply of fuel for the second stage pump, they generally do nothing to reduce running loss, and even increase it. The reservoir canisters typically have overflow openings back into the main tank, so heated return fuel can mix with the fuel in the main tank, raising the temperature of the whole tank and increasing the rate of fuel vaporization. Some systems even use the flow of the return fuel to run a jet pump that actively forces more fuel from the main tank back into the canister, with the excess running out the top and back into the tank.

Fuel handling systems in the past have not been concerned with reducing running losses, only with assuring fuel supply and efficient fuel pump operation. An exception is the system disclosed in U.S. Pat. No. 4,989,572, issued Feb. 5, 1991, and assigned to the assignee of the subject invention. Hot return fuel is routed to a reservoir canister, but mixing of the return fuel with the main fuel store is substantially prevented. The reservoir canister has an internal pump, and is closed to the main tank, except for a vapor outlet into the main tank and a one-way make-up fuel inlet in the form of a flapper door. The flapper door opens easily to let cold make-up fuel in from the main tank when the hot return fuel alone is not adequate to meet engine demand. However, the flapper door shuts just as easily to stop substantially all of the hot return fuel from running out of the canister and back into the tank. While the system is very effective in reducing running losses, it may be unsuitable for vehicles with a high fuel demand engine. That is, make-up fuel from the main tank is supplied only passively, through the swinging door, rather than being actively forced in.

SUMMARY OF THE INVENTION

The invention provides a fuel handling system that actively supplies make-up fuel to the canister, but which still prevents mixing of the hot return fuel. In addition, an even greater measure of vapor formation reduction is achieved by maintaining the canister under an elevated internal pressure, that is, a pressure higher than the pressure within the fuel tank itself. The canister pressure is maintained even though it is periodically vented of its accumulated fuel vapor to the main tank.

In the preferred embodiment disclosed, the invention is incorporated in a vehicle with a fuel injection system that produces a continual flow of significantly warmed return fuel, which is also heavily mixed with entrained fuel vapor bubbles. A separate, cylindrical fuel canister contained within the main fuel tank is totally closed except for several deliberate openings. Specifically, the top of the canister includes a return fuel inlet, an engine fuel outlet, and a vapor outlet that has a predetermined size, all of which connect to hoses and lines, and none of which communicates directly with the fuel in the main tank. The bottom of the canister contains a make-up fuel inlet that does open to the fuel in the main tank, but which acts on a one-way basis to let fuel into the canister, but not out, because of additional structure described below.

A blocking valve in the form of a float controlled by the level of fuel in the canister is located below the vapor outlet. When the fuel level in the canister rises to a normal level sufficient to close the float valve, a vapor space is left between the liquid level surface and the top of the canister. When the blocking valve is open, there is an open path from the vapor space to the vapor dome of the main tank. In the particular embodiment disclosed, a specially designed separator depending from the return fuel inlet screens out the bubbles from the return fuel inlet and sends them into the vapor collection space. A second stage pump inside the canister sends fuel through the engine fuel outlet and to the fuel injection system of the engine as needed, with the unburned return fuel coming back through the return fuel inlet.

A first stage pump is run continually at a speed sufficient to supply any make-up fuel to the canister that may be needed to compensate for that sent out by the second stage pump and burned in the engine. The first stage pump is a non-positive displacement, turbine pump, which pressurizes the canister vapor space as it pumps fuel into the canister, a pressure that is elevated above the main tank pressure. The internal canister pressure so created suppresses the tendency of the hotter liquid fuel in the canister to vaporize more, which is not a function normally provided by the first stage pump. In addition, hot return fuel is prevented from exiting the canister by the continual running of the first stage pump, which effectively acts as a one-way inlet.

When there is a differential between fuel pumped and fuel returned, the size of the vapor space increases slightly, lowering its pressure slightly, and allowing the first stage pump to send in make up fuel until the vapor space is repressurized. The blocking valve remains closed, if the liquid level has not fallen low enough to open it. When enough fuel vapor collects in the vapor space to increase its volume, while remaining at or near the elevated internal pressure, then the liquid level is eventually forced down. When it sinks low enough to open the blocking valve, the first stage pump can again send in fuel, which now also acts to expel the excess vapor. Vapor expulsion occurs fast and frequently enough to keep it from reaching and vapor locking the second stage pump.

Despite the opening of the blocking valve, which breaks the effective enclosure of the canister, the elevated internal canister pressure is substantially maintained. This is achieved by a deliberate balancing of the first stage pumping capacity with the blocking valve vapor expulsion capacity. The first stage pump capacity is large enough, compared to the size of the vapor outlet, so that a pressure equilibrium is held as the vapor is expelled. Consequently, the vapor suppressing, elevated internal canister pressure is always substantially maintained.

It is, therefore, a general object of the invention to provide a fuel handling system that prevents mixing of the hot return fuel in the fuel tank while actively assuring a constant supply of fuel to the fuel canister.

It is another object of the invention to provide such a fuel handling system in which the fuel canister is continually maintained under an elevated, vapor suppressing internal pressure.

It is another object of the invention to continually maintain the canister internal pressure, while bleeding off fuel vapor, by carefully matching the pump capacity to the rate of vapor expulsion.

It is another object of the invention to maintain the fuel canister internal pressure substantially constant through the use of a continually running, non-positive displacement pump that maintains a vapor suppressing pressure within the canister when the fuel vapor outlet is closed, and which also has enough capacity to substantially maintain a vapor suppressing internal canister pressure even when the fuel vapor outlet opens.

DESCRIPTION OF THE PREFERRED EMBODIMENT

These and other objects and features of the invention will appear from the following written description, and from the drawings, in which.

Figure 1:
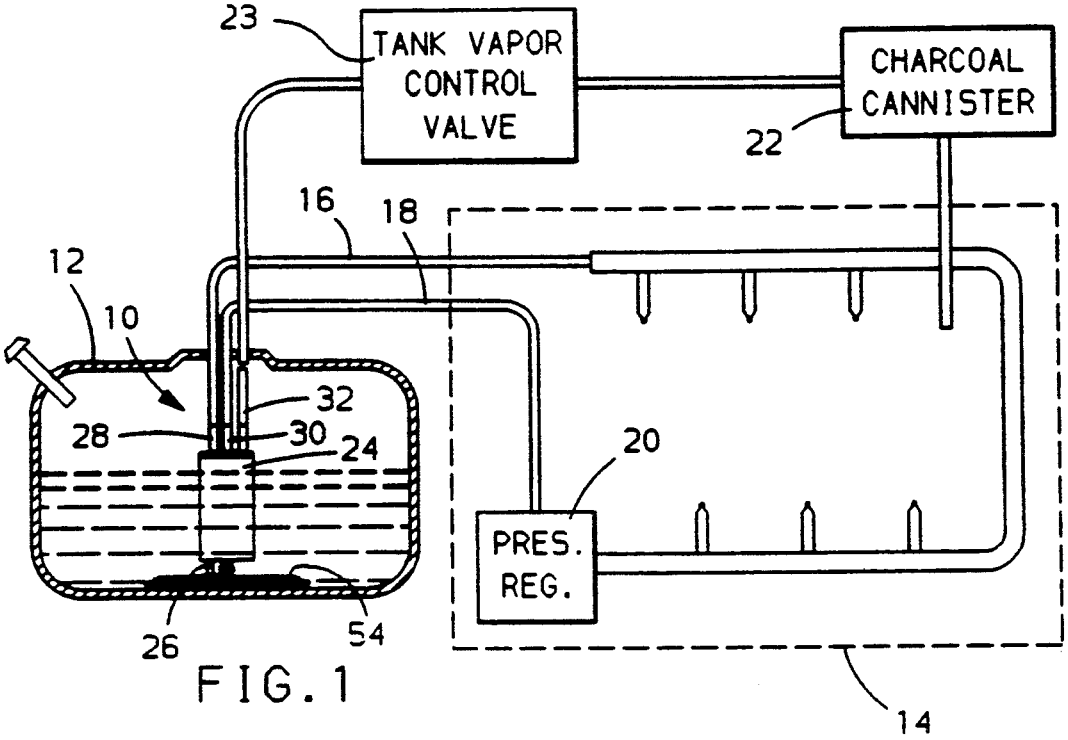
FIG. 1 is a schematic of a vehicle fuel system incorporating the fuel handling system of the invention.

Referring first to FIG. 1, the fuel handling system of the invention, indicated generally at (10), is incorporated in a vehicle having a conventional fuel tank (12) and fuel injection system (14). Fuel is pumped from tank (12) to injection system (14) through a supply line (16), but is not all utilized, with the excess being returned through a return line (18). Return fuel is significantly warmed, and is consequently more prone to vaporization than colder fuel. It is also suffused with small bubbles of entrained fuel vapor, in part because it also passes through a conventional pressure regulator (20) that drops the pressure of the return fuel from approximately 32–45 psi to 0.5–1.0 psi. Fuel vapors that form inside tank (12) are vented to a vapor storage device (22) through a control valve (23) that maintains the interior of tank (12) at approximately 0.5–1.0 psi. Dumping return fuel directly back into tank (12) would elevate its temperature significantly, and increase the volume of fuel vapor. Furthermore, it is not feasible to keep the pressure within tank (12) high enough to significantly suppress vapor formation. Fuel handling system (10) is able to reduce fuel vapor formation both by preventing return fuel mixing, and by pressure suppression, but without pressurizing the interior of tank (12), and without jeopardizing the constant supply of fuel to injection system (14).

Figure 2:
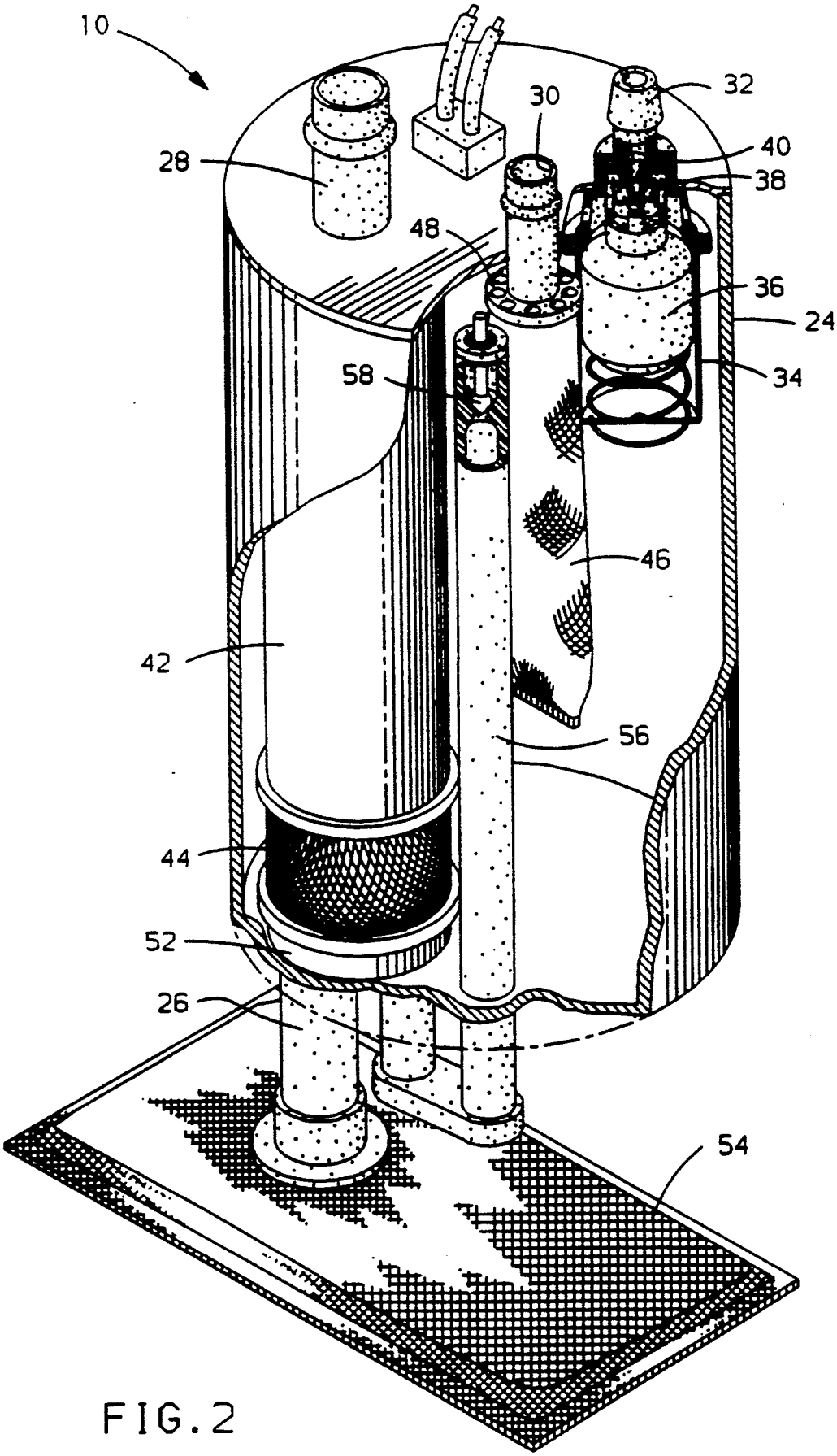
FIG. 2 is a perspective view of the vapor outlet and level controlled blocking valve alone, with part of the valve housing broken away.

Referring next to FIG. 2, the structural details of a preferred embodiment of the fuel handling system of the invention are illustrated. "Fuel handling system" is self-explanatory, meaning the system that directly handles sending an adequate supply of fuel to the injection system (14), receiving the return fuel therefrom, and which also assures proper operation of the various pumps. The fuel handling system of the invention provides those conventional features in addition to the vapor reduction noted above. Part of the fuel handling function consists of simply providing a reservoir or sump that will collect and hold fuel and retain it near the fuel pump inlet in the event of fuel sloshing within tank (12). Typically, the reservoir function has been provided by a canister or the like, and a cylindrical fuel canister (24) serves the same function here. Canister (24) is approximately six and one-half inches high by four inches in diameter, and sits vertically inside tank (12). Unlike conventional fuel reservoirs, canister (24) is enclosed, but for a make-up fuel inlet tube (26) through the bottom, a fuel outlet tube (28) through the top, a return fuel inlet tube (30) through the top, and a fuel vapor outlet tube (32) through the top. None of these openings is communicated directly with the liquid fuel inside tank (12). Tube (28) is attached to supply line (16), tube (30) to return line (18), and tube (32) would open through a vent tube high within the interior tank (12), above its fuel level. Furthermore, each is effectively closed during operation of the system (10). Given the fact that canister (24) also has a greater wall thickness than tank (12), it is therefore feasible to internally pressurize it, in a manner described below. Canister (24) also serves as the structural foundation for several other components of system (10), described next.

Figure 3:
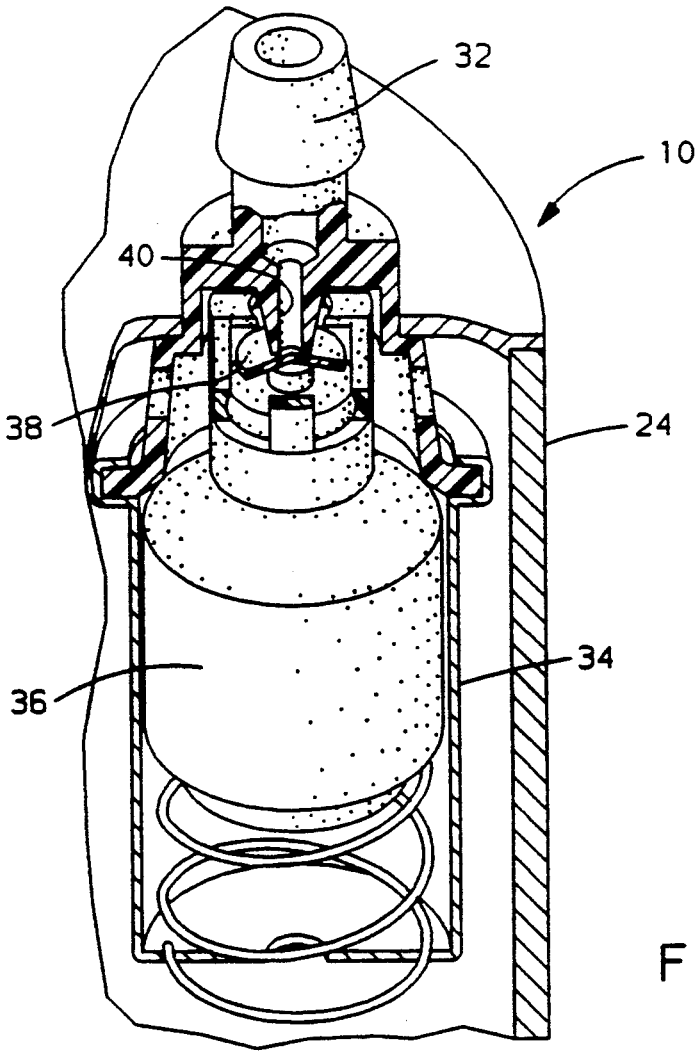
FIG. 3 is a perspective view of a preferred embodiment of the fuel handling system alone with part of the canister broken away.

Referring next to FIGS. 2 and 3, a fuel level controlled blocking valve is comprised of a small cylindrical float chamber (34) fixed to the top of canister (24) within which a spring balanced float (36) is axially movable toward and away from fuel vapor outlet tube (32). Specifically, the top of float (36) is adapted to push or pull a small disk (38) toward or away from an orifice (40) that opens to vapor outlet tube (32). The size of orifice (40) is determined so as to yield a sufficient rate of vapor venting from canister (24), while maintaining a desired elevation in internal pressure, as is further described below. In the embodiment disclosed here, orifice (40) is 0.125 inches in diameter. Since float chamber (34) is thoroughly vented to the interior of canister (24), the liquid and vapor levels in the two will substantially match. However, as the liquid level in float chamber (34) falls far enough for float (36) to sink, disk (38) will not be pulled away from orifice (40) immediately. This so called "corking" effect or lag is generally undesirable in most applications. In fact, the blocking valve shown is intended for use as a socalled "roll over" valve in fuel tanks and is designed to reduce corking. However, a small reopening lag is actually beneficial to the invention here, as will be apparent when the operation is described in more detail below.

Referring next to FIG. 2, canister (24) also contains a basically conventional second stage fuel pump (42) that sends fuel from canister (24) to injection system (14) as needed. Second stage pump (42) has a screened inlet window (44) located at a fairly low point within canister (24), through which fuel is drawn. While a fuel pump like (42) could be designed to run faster or slower in response to engine demand, in point of fact it is run more or less continually, rather than attempting to match its output directly to engine need. Fuel is sent through outlet tube (28) to supply line (16) at a pressure of approximately 32–45 psi, and the fuel not used is returned past pressure regulator (20) to return tube (30). It is important that fuel vapor be kept away from inlet window (44) to avoid vapor lock, which is assured by another internal component, described next.

Figure 4:
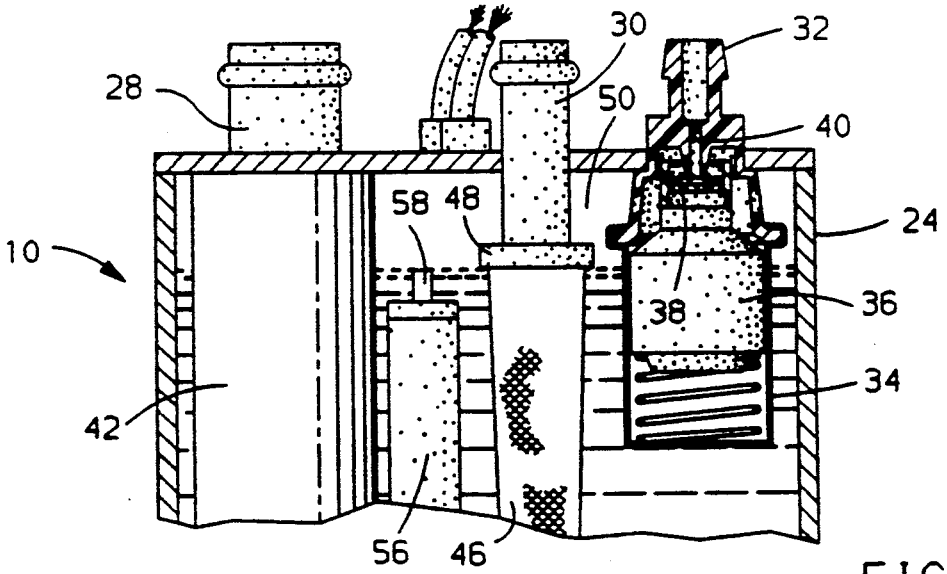
FIG. 4 is a schematic view of the invention in operation, when the fuel in the canister is at the normal level with the blocking valve closed.

Referring next to FIG. 4, a specially designed vapor separator (46) depends from return fuel inlet tube (30). Vapor separator (46) is a tube of fuel resistant mesh fabric that screens out and retains the entrained fuel vapor bubbles, but passes the liquid return fuel to the interior of canister (24). It is closed on the bottom, and opens less than an inch from the top of canister (24) through an annular ring (48) that is pierced by eight 3/32 inch holes. Separator 46 accomplishes several objectives. As the return fuel splashes into the tube, it is restrained and damped, losing some energy, so that it seeps into the fuel already in canister (24). This damping effect aids in keeping the fuel fill inside canister (24) still and "solid", that is, free of whirlpools and localized vortices that increase vaporization and swirl vapor bubbles down toward inlet window (44). The screened in bubbles rise toward the top, bumping and coalescing into larger bubbles that pass through ring (48). As shown in FIG. 4, there is a vapor space (50) between the fuel level and the top of canister (24) which has an axial depth of at least about half an inch, within which ring (48) sits, and into which the fuel vapor bubbles can exit, far removed from inlet window (44). If fuel has temporarily risen high enough to restrict the vapor space (50), the enlarged fuel bubbles will still cling to the top, since they have reduced mobility and cannot be easily drawn downwardly. With time, the vapor space (50) will grow deep enough to have to be vented and replaced with make-up fuel from tank (12).

Figure 7:
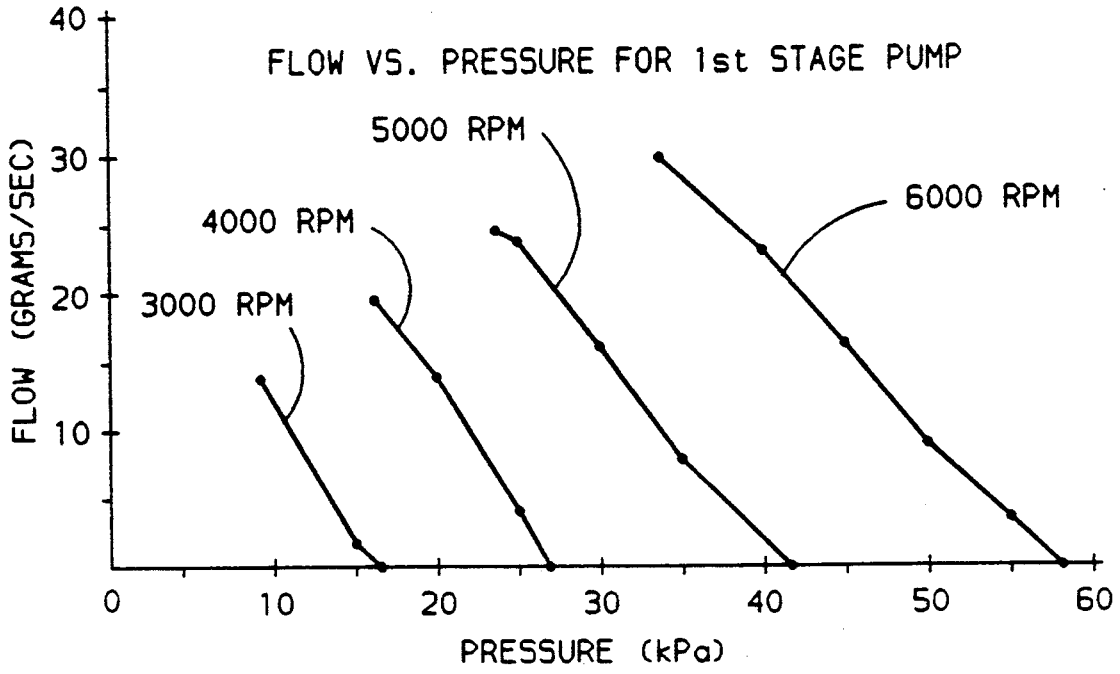
FIG. 7 is a flow curve for the particular first stage pump used in the invention, showing the characteristic pressure that the first stage pump can maintain at various flow rates and at various running speeds.

Referring next to FIGS. 2, 4, and 7, the details of first stage pump (52) are illustrated. First stage pump (52) sits below inlet second stage pump (42), and draws in make-up fuel from tank (12) through inlet tube (26), through a standard filter sock (54). Fuel is discharged indirectly through a stand pipe (56) that also opens near the top of canister (24), on a level similar to ring (48). The stand pipe (56) prevents immediate leak down in the event that make-up fuel cannot reach inlet (26), so that canister (24) provides a reservoir function. A passively acting check valve (58) lets make-up fuel enter, but blocks vapor from being driven down stand pipe (56), preventing vapor lock. First stage pump (52) is a non-positive displacement, turbine pump, which is run continually. As can be seen from FIG. 7, first stage pump (52) has a characteristic set of pressure curves, which are plotted as a function of the pump's flow rate and speed in RPM. For example, at 4000 RPM, first stage pump (52) can produce a flow into canister (24) ranging from 0–20 grams per second, and at a pressure of about 16 to 27 kPa (or about 2.5 to 3 psi). Higher flow rates come at lower pressures, and vice versa.

The features described so far contribute to fuel vapor reduction in several ways. First, vapor reduction results from preventing return fuel from mixing back into tank (12), as with the system in U.S. Pat. No. 4,989,572. This is because the first stage pump (52), by always running, effectively acts as a one-way inlet between tank (12) and canister (24). That is, it is either pumping fuel in to make up a fuel deficit, or is stalled out while attempting to pump fuel in, providing a one way action. Second, as already noted, the limited volume in the vapor space (50) and the still, solid fuel fill of canister (24) achieved by the vapor separator (46) helps to reduce vaporization. Third, and most important to the invention, an elevated internal pressure is maintained in canister (24), specifically in the vapor space (50) which, acting on the surface of the liquid fuel below, suppresses fuel vaporization within canister (24), as is described next.

Referring next to FIGS. 4 and 7, the actual operation of fuel handling system (10) is illustrated. It will be recalled that during operation of the vehicle, three of the four openings into canister (24) are effectively closed by virtue of being filled with fuel. As seen in FIG. 4, when the amount of fuel vapor in canister (24) is relatively small, and is not growing, then the resultant vapor space (50) remains small, and the corresponding fuel level remains high. Orifice (40) is consequently also closed by float (36). Therefore, the first stage pump (52), as it runs at any given constant speed and attempts to pump fuel into canister (24), will work against and pressurize vapor space (50). When the pressure in vapor space (50) is equal to that which first stage pump (52) can produce, that will be the effective flow rate that first stage pump (52) can produce. If engine demand is low, and almost all fuel is consequently being returned to canister (24), then the liquid level remains relatively high. If fuel is used, however, then the liquid level falls, the size of vapor space (50) grows and, if the amount of vapor is still relatively constant, the pressure in vapor space consequently falls slightly. This allows the flow rate of first stage pump (52) to go up to an extent, sending in make up fuel and repressurizing vapor space (50) until its flow rate again decreases. Therefore, so long as the amount of vapor in canister (24) is relatively constant, an effective equilibrium is reached between the flow rate of first stage pump (52) and engine demand, and the vapor space (50) remains pressurized, to a greater or lesser extent, but averaging higher than the pressure in tank (12). This internal pressurization of canister (24) suppresses the rate of fuel vaporization that would otherwise occur.

Figure 5:
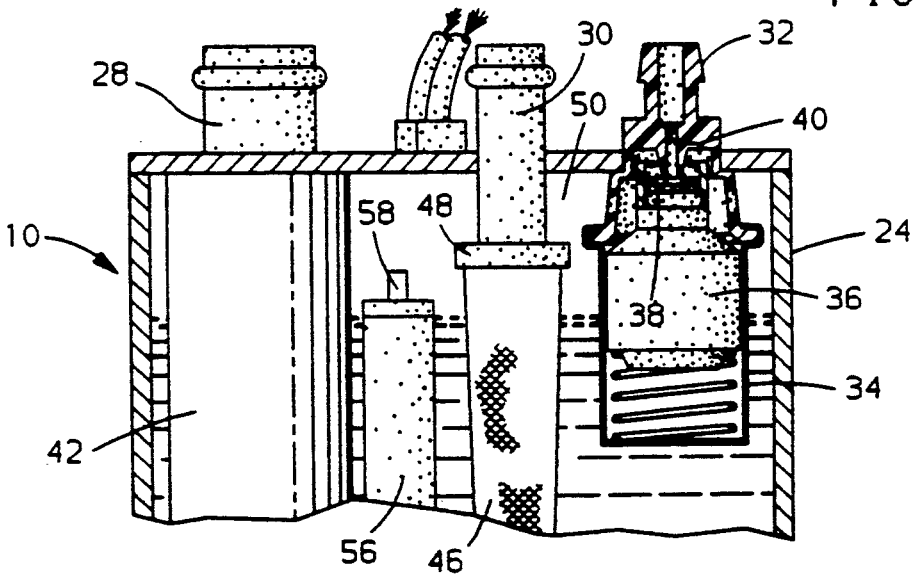
FIG. 5 is a view with the fuel level low enough to open the blocking valve, but before the blocking valve has yet opened.
Figure 6:
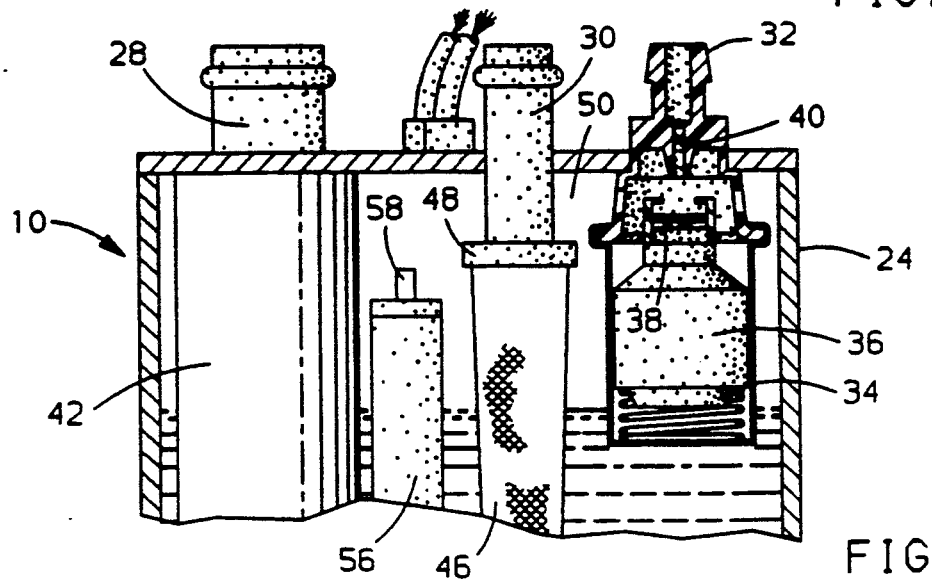
FIG. 6 is a view with the blocking valve open, fuel vapor being expelled, and make-up fuel being added.

Referring next to FIGS. 5 and 6, the operation of float (36) and orifice (40) are illustrated. The amount of vapor in canister (24) does not remain constant. As more and more fuel vapor is removed by the vapor separator (46) and sent into vapor space (50), it grows in size, while remaining at the same equilibrium internal pressure described above. The first stage pump (52) is therefore able to send in less and less make up fuel, and the resultant level of liquid fuel in canister (24) falls. If the vapor space (50) were to grow far enough to reach inlet window (44), vapor lock could be a problem. The fuel system (10) is designed to vent before that occurs, however. Float (36) eventually falls far enough to strip disk (38) from orifice (40) and open vapor outlet (32). At that point, the pressure in vapor space (50) can drop slightly, and first stage pump (52) can increase its flow rate and begin to send in more fuel just as described above. Now, the addition of fuel by first stage pump (52) also acts to expel the accumulated vapor from canister (24) through vapor outlet (32). Fuel rises in canister (24) until the normal level is again reached and float (36) closes, and the internal pressure in canister (24) again rises to the equilibrium value described above. The lag that results from the slightly delayed falling of float (36) prevents first stage pump (52) from operating in a rapid fire, stuttering fashion. As vapor venting occurs, the internal pressure in canister (24) falls somewhat, but will remain at a vapor suppressing pressure higher than the pressure in main tank (12), unless the rate of vapor expulsion is so rapid as to bleed off that internal pressure. This is prevented, as is further described next.

The general considerations and methodology that determine the sizing of orifice (40) and the choice of the operating parameters of first stage pump (52) can be explained in general, although no hard and fast formula need be given. Orifice (40) must be large enough to allow fuel vapor to be expelled quickly enough that it does not reach inlet window (44). This alone would argue for a large orifice (40). However, too large an orifice (40) would only assure that the internal pressure in canister (24) dropped to equal the pressure in tank (12). Achieving a balance between the capacity of first stage pump (52) and the size of orifice (40) involves elements of both the analytical and the empirical, since one affects the other. That is, for a given size orifice (40), a more powerful first stage pump (52) would be needed to expel vapor and still maintain the elevated internal pressure in canister (24). However, even if a given first stage pump (52) were powerful enough to "keep up" with the rate of vapor expulsion through the orifice (40), that expulsion rate still might not be great enough to vent canister (24) fast enough. Therefore, an educated estimate of one or the other has to be made, and then the two can be adjusted relative to one another until satisfactory, dynamically balanced operation is achieved.

Figure 8:
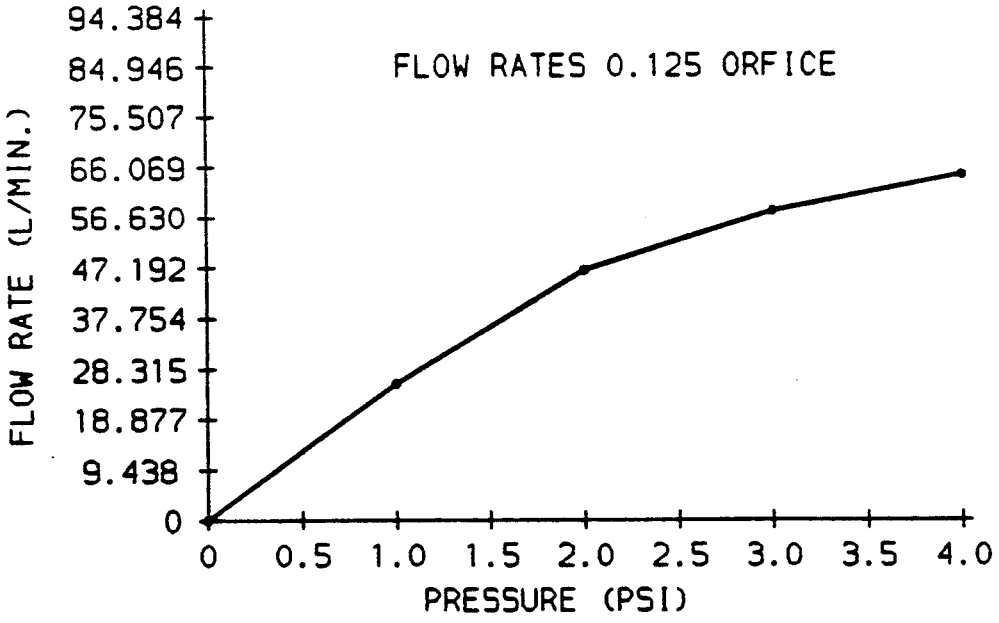
FIG. 8 is a flow versus pressure plot for the blocking valve used in the preferred embodiment.

Referring next to FIGS. 7 and 8, the specific factors that went into the design of the particular embodiment disclosed may be explained. The first stage pump (52), of course, will have to make up what the second stage pump uses (42), in any fuel system. For the particular vehicle engine involved, it was determined that the first stage pump (52) would need sufficient capacity to provide make-up fuel for second stage pump (42) in the range of between 7 to 13 grams of fuel per second. This range would be calculated for any engine based upon maximum and minimum engine fuel demand, plus whatever maximum amount of fuel is vaporized in the fuel system. The amount of fuel that is vaporized is greatest when the rate of fuel returned is greatest (and engine demand is least), and so represents an additional increment to the low end of the range noted above. The maximum amount of fuel vaporized can be calculated fairly closely by measuring the fuel temperature and pressure on each side of the pressure regulator (20), and then consulting fuel distillation charts to estimate how much liquid fuel would be vaporized. For the particular engine used here, it was estimated that approximately 3 grams of fuel per second would be vaporized, which is reflected in the 7 gram low end of the range noted above.

Once a necessary range of fuel flow for first stage pump (52) is determined, the characteristic curves, like those in FIG. 7, can be consulted to choose an operating speed that will provide it. Here, a pump speed of approximately 4,000 RPM is adequate. At that speed, first stage pump (52) is capable of maintaining an internal pressure in canister (24) of between 2.5 to 3 psi when orifice (40) is closed, and close to that when it is open, provided that orifice (40) is not so large as to bleed the pressure off when it opens. Of course, orifice (40) still must be large enough to allow vapor to be expelled before it reaches inlet window (44), as noted above. If the designer has facility with analytical tools such as gas equations and Reynolds numbers, and knows the gram molecular weight of the low end components of the fuel involved, then the volume of fuel vapor that the 3 (or whatever) grams of liquid fuel vaporized is likely to produce can be calculated fairly closely. Here, that was calculated to be approximately 55 liters per minute. Then, the vapor flow rate that various diameters of orifice (40) are able to provide over the pressure range desired can be determined. This data will generally be available from valve manufacturers, if a standard valve is used. Here, as seen in FIG. 8, a valve orifice of 0.125inches was adequate.

The same sizing of orifice (40) can be done empirically, once a fuel flow rate range and running speed have been chosen for first stage pump (52), by starting with a large or small orifice (40), and then changing the orifice size successively, while monitoring the internal pressure of canister (24), until a dynamic balance is achieved where adequate vapor expulsion is achieved while maintaining the internal pressure. Higher speeds and capacity for the first stage pump (52) would allow a larger orifice (40) to be chosen, while still maintaining pressure. A higher speed and capacity for first stage pump (52) at a given size of orifice (40) will create a higher internal pressure and greater vapor suppression in canister (24). Testing has indicated that the vapor reduction that can be achieved is significant, even with the relatively low internal pressure produced in the disclosed embodiment. Whereas a total system vapor generation of 2321 grams was achieved for the non-pressurized system referred to in U.S. Pat. No. 4,989,572 above, testing of the subject invention has indicated a total loss of only 839 grams.

Variations in the disclosed embodiment could be made. Without a vapor separator like (46), vapor would still rise and collect in vapor space (50). It does so much more efficiently with separator (46), however, which provides the other advantages noted. Another type of vapor separator could conceivably be provided, although (46) is particularly simple and compact. While adequate internal pressurization for canister (24) is provided by the two stage pump disclosed, it is possible that pumps with more than two stages could be incorporated to further boost pressure. Therefore, it will be understood that it is not intended to limit the invention to just the embodiment disclosed.

The embodiments of the invention in which an exclusive property or privilege is claimed are defined as follows:

1. In a vehicle having a main fuel tank and an engine that creates a back flow of return fuel to said main tank that is elevated in temperature and therefore prone to increased vaporization, a fuel handling system, comprising, a fuel canister separate from said main fuel tank and completely enclosed but for a make up fuel inlet from said main fuel tank, a fuel outlet to said engine, a return fuel inlet from said engine that receives said return fuel, and a fuel vapor outlet through the top of said canister having a predetermined size, a second stage pump adapted to pump fuel from said fuel canister and through said fuel outlet to said engine as needed and then back to said canister through said return fuel inlet, a fuel level controlled blocking valve adapted to close said fuel vapor outlet when the fuel level within said canister is at or above a normal level below the top of said canister, so that vapor from said return fuel will rise and collect in a vapor space located between the level of fuel in said canister and the top of said canister, and to open when enough vapor has collected in said vapor space to lower the level of fuel within said canister below said normal level, a first stage pump having sufficient capacity to continually pump fuel from said main fuel tank through said make up fuel inlet and into said canister to compensate for the fuel pumped out by said second stage pump, thereby pressurizing said vapor space and creating an elevated canister internal pressure when said blocking valve is closed while expelling vapor through said vapor outlet when said blocking valve is open, said predetermined vapor outlet size being small enough, relative to said first stage pump capacity, to substantially maintain said canister internal pressure as said vapor is being expelled, whereby a constant supply of fuel to said second stage pump is actively maintained while fuel vapor formation within said canister is continually suppressed by the maintenance of said elevated canister internal pressure.

2. In a vehicle having a main fuel tank and an engine that creates a back flow of return fuel to said main tank that is elevated in temperature and therefore prone to increased vaporization in addition to being mixed with entrained fuel vapor bubbles, a fuel handling system, comprising, a fuel canister separate from said main fuel tank and completely enclosed but for a make up fuel inlet from said main fuel tank, a fuel outlet to said engine, a return fuel inlet from said engine that receives said return fuel, and a fuel vapor outlet through the top of said canister having a predetermined size, a second stage pump adapted to pump fuel from said fuel canister and through said fuel outlet to said engine as needed and then back to said canister through said return fuel inlet, a fuel vapor separator into which said return fuel enters to separate said entrained bubbles of fuel vapor and send said separated fuel vapor into a vapor space located between the level of fuel in said canister and the top of said canister, a fuel level controlled blocking valve adapted to close said fuel vapor outlet when the fuel level within said canister is at or above a normal level below the top of said canister and to open when enough vapor has collected in said vapor space to lower the level of fuel within said canister below said normal level, a first stage pump having sufficient capacity to continually pump fuel from said main fuel tank through said make up fuel inlet and into said canister to compensate for the fuel pumped out by said second stage pump, thereby pressurizing said vapor space and creating an elevated canister internal pressure when said blocking valve is closed while expelling vapor through said vapor outlet when said blocking valve is open, said predetermined vapor outlet size being small enough, relative to said first stage pump capacity, to substantially maintain said canister internal pressure as said vapor is being expelled, whereby a constant supply of fuel to said second stage pump is actively maintained while fuel vapor formation within said canister is continually suppressed by the maintenance of said elevated canister internal pressure.

* * * * *